US010232219B2

(12) United States Patent
Arias

(10) Patent No.: US 10,232,219 B2
(45) Date of Patent: Mar. 19, 2019

(54) ARTICULATING JOINT EXERCISE APPARATUS AND METHOD

(71) Applicant: Arias Physical Therapy Inc., Walla Walla, WA (US)

(72) Inventor: George Arias, Walla Walla, WA (US)

(73) Assignee: Arias Physical Therapy Inc., Walla Walla, WA (US)

( * ) Notice: Subject to any disclaimer, the term of this patent is extended or adjusted under 35 U.S.C. 154(b) by 0 days.

(21) Appl. No.: 15/418,581

(22) Filed: Jan. 27, 2017

(65) Prior Publication Data

US 2018/0214738 A1 Aug. 2, 2018

(51) Int. Cl.

| | |
|---|---|
| ***A63B 23/04*** | (2006.01) |
| ***A63B 21/00*** | (2006.01) |
| *A63B 23/00* | (2006.01) |
| *A63B 22/00* | (2006.01) |
| *A63B 22/20* | (2006.01) |

(52) U.S. Cl.

CPC ..... *A63B 23/04* (2013.01); *A63B 21/4015* (2015.10); *A63B 21/4045* (2015.10); *A63B 22/0046* (2013.01); *A63B 22/20* (2013.01); *A63B 22/201* (2013.01); *A63B 22/203* (2013.01); *A63B 2022/0094* (2013.01); *A63B 2023/006* (2013.01)

(58) Field of Classification Search

CPC ..... A63B 21/4015; A63B 21/4045; A63B 21/00178; A63B 21/002; A63B 21/0023; A63B 21/28; A63B 21/285; A63B 23/04; A63B 23/03508; A63B 23/0355; A63B 23/03558; A63B 2023/006; A63B 22/0046; A63B 22/20; A63B 22/201; A63B 22/203; A63B 2022/0094

See application file for complete search history.

(56) References Cited

U.S. PATENT DOCUMENTS 2,720,396 A * 10/1955 Pfaus ..... A63B 23/03533 482/130
4,229,001 A * 10/1980 Roman ..... A63B 21/012 482/114
5,277,681 A * 1/1994 Holt ..... A61H 1/02 482/112
8,249,714 B1 * 8/2012 Hartman ..... A61N 1/36003 607/48

(Continued)

*Primary Examiner* — Megan Anderson
(74) *Attorney, Agent, or Firm* — Wells St. John P.S.

(57) ABSTRACT

An articulating joint exercise apparatus is provided having a portable structural frame, a slide, a body-engaging mounting fixture, and a brake. The slide has a friction-reducing bearing surface configured for movement along the rail extending between a range corresponding with extension and retraction of a user limb and associated user joint that exceeds an end range for a user under rehabilitation corresponding with hyperextension and hyperflexion. The body-engaging mounting fixture is affixed for articulation to the slide and is configured to attach to a user limb of a user joint. The brake is carried by the slide and is configured to be actuated by a user to affix the slide and body-engaging mounting fixture at one of an anatomically limited terminal range with a static stretch of a user joint when a limb of a user joint is affixed to the mounting fixture. A method is also provided.

20 Claims, 10 Drawing Sheets

(56) References Cited

U.S. PATENT DOCUMENTS

| | | | | |
|---|---|---|---|---|
| 8,425,437 | B2 * | 4/2013 | Zaborowski | A61H 1/0237 482/70 |
| 8,740,758 | B2 * | 6/2014 | Sandvig | A63B 21/0442 482/121 |
| 9,011,296 | B2 * | 4/2015 | Peralo | A61H 1/02 482/123 |
| 9,474,675 | B2 * | 10/2016 | Hansen | A63B 21/4045 |
| 2009/0137369 | A1 * | 5/2009 | Branch | A61H 1/0259 482/112 |
| 2012/0077653 | A1 * | 3/2012 | Dedov | A47C 9/002 482/139 |
| 2013/0245510 | A1 * | 9/2013 | Zaborowski | A61H 1/0237 601/33 |
| 2015/0374574 | A1 * | 12/2015 | Cataldi | A61H 1/0259 601/5 |

* cited by examiner

ARTICULATING JOINT EXERCISE APPARATUS AND METHOD

TECHNICAL FIELD

This disclosure pertains to exercise and rehabilitation equipment and techniques. More particularly, this disclosure relates to rehabilitation apparatus and methods for exercising and rehabilitating a mammalian joint.

BACKGROUND

Techniques are known for exercising and rehabilitating mammalian joints, particularly long bone joints of humans that actively participate in athletic events. For the case of human knee joint injuries, it is known to perform articulation motion exercises repetitively to a user's joint to condition the joint during rehabilitation. However, there exists a need to further improve the manner in which such exercises extend and hold a joint past a normal range of motion when the joint has restricted motion resulting from injury or degeneration.

SUMMARY

An exercise and/or rehabilitation apparatus and method are provided for use in rehabilitating and/or reconditioning a mammalian joint.

According to one aspect, an articulating joint exercise apparatus is provided having a portable structural frame, a slide, a body-engaging mounting fixture, and a brake. The portable structural frame has an elongate rail. The slide has a friction-reducing bearing surface configured for movement along the rail extending between a range corresponding with extension and retraction of a user limb and associated user joint that exceeds an end range for a user under rehabilitation corresponding with hyperextension and hyperflexion. The body-engaging mounting fixture is affixed for articulation to the slide and is configured to attach to a user limb of a user joint. The brake is carried by the slide and is configured to be actuated by a user to affix the slide and body-engaging mounting fixture at one of an anatomically limited terminal range with a static stretch of a user joint when a limb of a user joint is affixed to the mounting fixture.

Normally hyperflexion and hyperextension medically speaking pertains to an abnormality, injury or deficit. For the purpose of this device it is appropriate to state hyperflexion or hyperextension as it relates to movement beyond a current restricted range of motion due to injury or surgery. Hyperflexion or hyperextension indicates improvement beyond the current restricted joint motion in order to achieve full active range of motion for that particular joint.

According to another aspect, a patient exercise apparatus is provided having an elongate rail, a slide, a body-engaging mounting fixture, and a brake. The slide has a friction-reducing bearing surface configured for reciprocating movement along the rail corresponding with extension and retraction of a user limb and user joint. The body-engaging mounting fixture is affixed for articulation to the slide and configured to attach to a user limb of a user joint. The brake is carried by the slide and configured to be actuated by a user to affix the slide and body-engaging mounting fixture at one of an anatomically limited terminal range of terminal extension and terminal retraction with a static stretch of a user joint when a limb of a user joint is affixed to the mounting fixture According yet another aspect, a method of performing a rehabilitation exercise on a patient joint is provided. The method includes: providing a frame having an elongate rail, a slide having a friction-reducing bearing surface configured for reciprocating movement along the rail, a body-engaging mounting fixture affixed pivotally to the slide, and a brake; affixing a user limb associated with a user joint to the body-engaging mounting fixture; moving the slide along the rail by articulating the limb and the user joint to a position that exceeds an end range for a user under rehabilitation corresponding with one of hyperextension and hyperflexion beyond an anatomically limited terminal range comprising a static stretch position; and affixing the translating member at the position by engaging the brake to hold the limb and the joint in the static stretch position.

DETAILED DESCRIPTION OF THE ILLUSTRATED EMBODIMENTS

This disclosure of the invention is submitted in furtherance of the constitutional purposes of the U.S. Patent Laws "to promote the progress of science and useful arts" (Article 1, Section 8).

Figure 1:
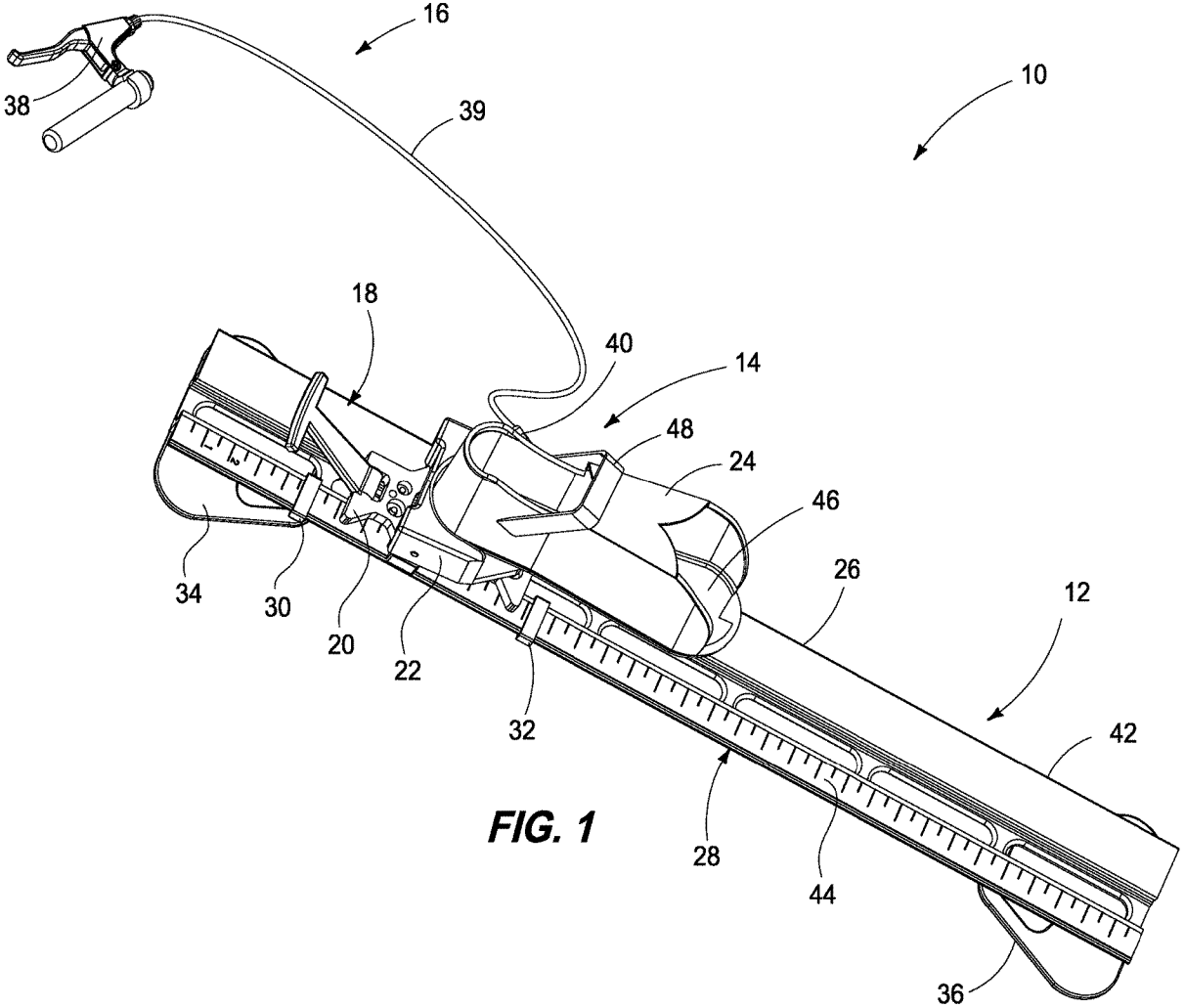
FIG. 1 is a perspective view of one version of an articulating joint exercise apparatus illustrating an elongate rail and body-engaging mounting fixture confirmed to mate with a user's foot when performing rehabilitation on a knee joint according to one embodiment

FIG. 1 illustrates an articulating joint exercise apparatus 10 in the form of a knee joint rehabilitation apparatus, according to one implementation. Apparatus 10 includes an elongate rail, or track 12 that supports a slide mount assembly 14 for reciprocating movement along the rail 12 extending between a range corresponding with extension and retraction of a user limb and associated user joint that exceeds an end range for a user under rehabilitation corresponding with hyperextension and hyperflexion.

Slide mount assembly 14 includes a brake system, or linear (or elongate) guide rail brake 16 carried by the slide 14 and configured to be actuated by a user to affix the slide 14 and a body-engaging mounting fixture, or foot rest 24 at one of an anatomically limited terminal range with a static stretch of a user joint when a limb of a user joint is affixed to the mounting fixture 24. Brake system 16 includes a brake handle assembly 38, a brake cable 39 and a disc brake assembly 40. According to one implementation, brake system 16 is a disc brake assembly for a bicycle, such as a Shimano M375 bicycle mechanical rear disc brake caliper 83 available from Shimano American Corporation, One Holland, Irvine, Calif. 92618 U.S.A.. Assembly 40 of caliper 83 is shown simplified in cross section with a piston 81 that urges together pads 78 and 79 about track 42 Optionally, any other form of disc brake caliper or other suitable mechanical or hydraulic brake including cantilever brakes with rubber pads can be utilized.

Slide mount assembly 14 includes a neoprene rubber body-engaging mounting fixture in the form of a boot 24 having a neoprene or nylon strap 48 having a hook and loop closure tab system. A thin plastic foot plate is received inside of boot 24, between an upper and a lower neoprene foot sole layer and fasteners (not shown) pass through complementary recessed apertures in plate 46, boot 24 and into threaded standoffs, or posts 58 in heel piece 22, as shown in FIG. 9.

A flexion driver, or pull handle 18 is provided at a proximal end of a carriage, or car 20 of slide mount assembly 14. Handle 18 pivotally affixed to a pin 64 on carriage 20 (see FIG. 9).Carriage 20 is configured to move to and fro axially along linear rail 12. Rail 12, according to one implementation, has an elongate, or linear brake track 42 having top and bottom brake surfaces formed in an extruded linear guide rail member 26. An articulation gauge, or recorder 28 is provided parallel to brake track 42 on rail member 26 along a laterally opposed edge. A pair of proximal and distal sliders, or position recorders 30 and 32 are provided on opposed ends of carriage 20 configured to be slid to positions that correspond with maximal flexion and extension, respective of a user joint when a user's limb is affixed to boot 24. Sliders 30 and 32 travel along a range quantifier, or ruler 44 of linear gauge 28. Such sliders are moved when carriage 20 engages and pushes each respective slider 30 and 32 when a user articulates a joint to a maximal flexion and extension position, respectively.

Figure 2:
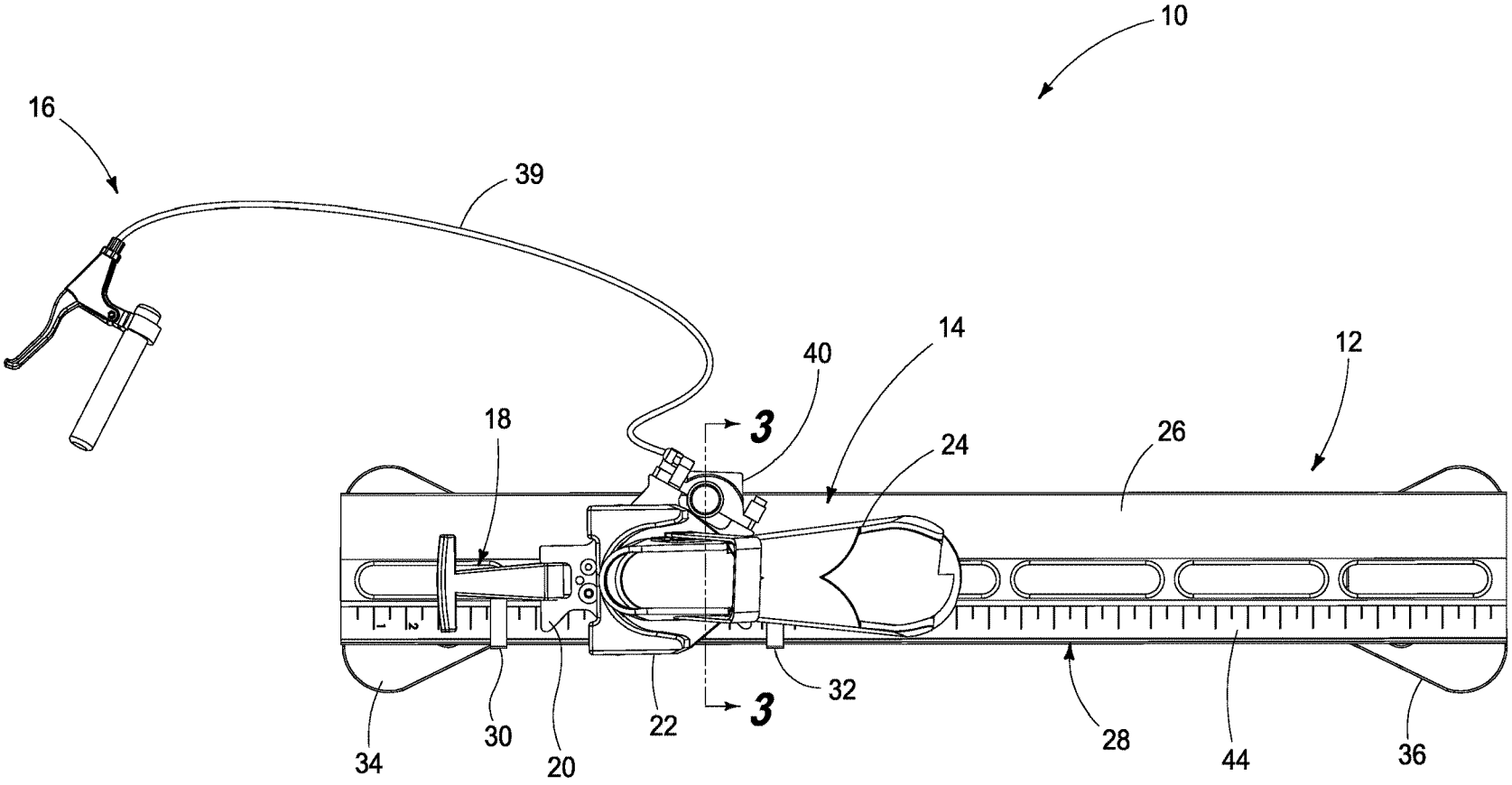
FIG. 2 is a plan view from above of the articulating knee joint exercise apparatus of FIG. 1.
Figure 9:
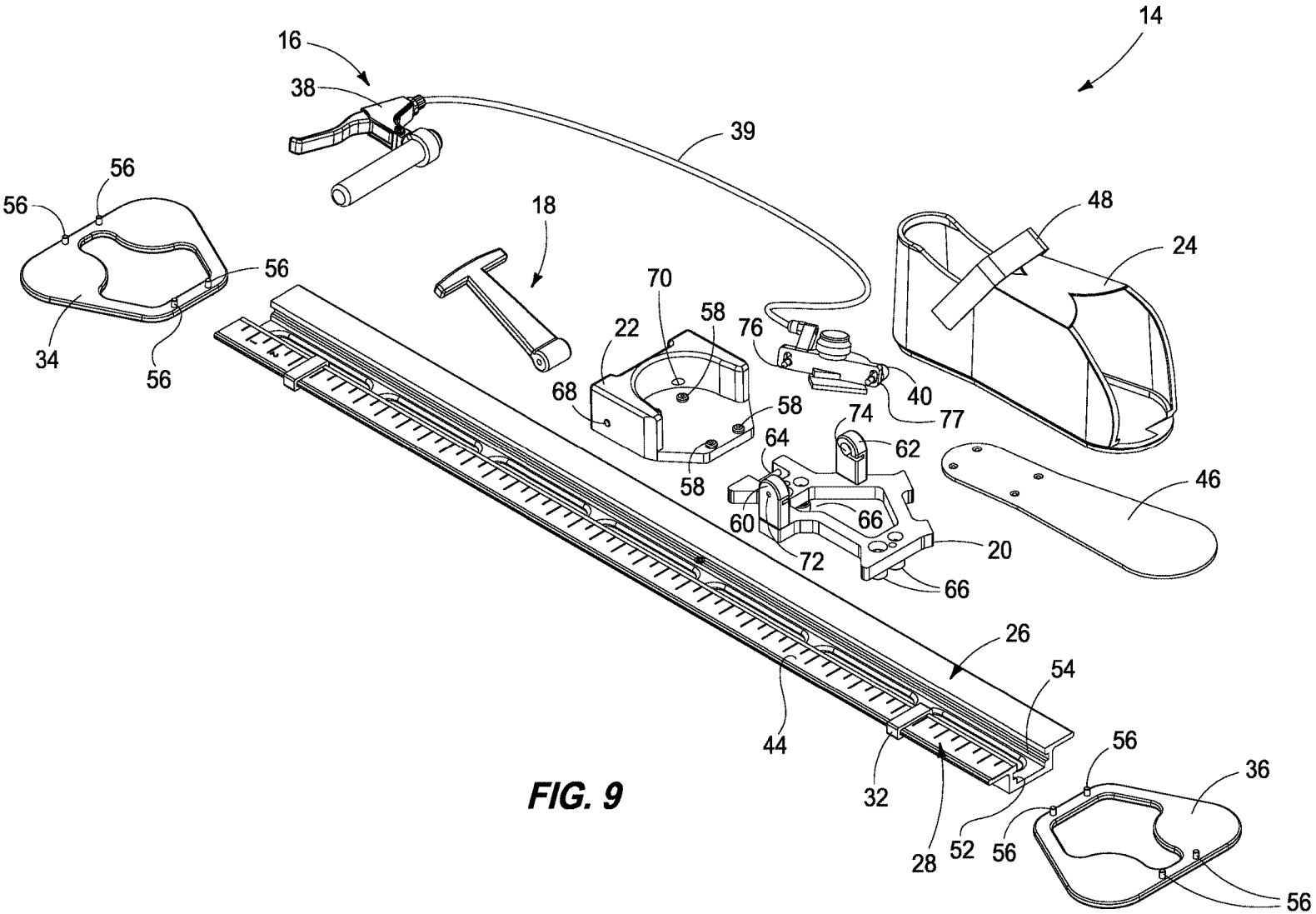
FIG. 9 is an exploded perspective view from above of the articulating knee joint apparatus of FIGS. 1-7.

As shown in FIGS. 1, 2 and 9, elongate rail 12 includes a pair of enlarged surface area base plates 34 and 36 that are affixed to a bottom surface of rail member 26 at proximal and distal ends, respectively. Base plates 34 and 36 have enlarged planar surface areas to stabilize rail 12 when placed on a horizontal support surface, such as a floor or table. In assembly, four recessed head threaded fasteners 56 extend through holes in each base plate 34 and 36 and into complementarily threaded bores (not shown) formed in a bottom surface of rail member 26, as shown in FIG. 9.

Furthermore, sliders 30 and 32 each comprise a plastic rectangular slide clip having an open lateral slot that enables each slider 30 and 32 to envelope a flange on rail member 26 that forms ruler 44, as shown in FIG. 9. Optionally, sliders 30 and 32 can be constructed from metal, such as anodized aluminum, or any other suitable structural material, such as a composite material. Geometric tolerances on each slider 30 and 32 provide for smooth sliding of each slider 30 and 32 when urged backward and forward, respectively, during flexion and extension by a user that moves carriage 20 to engage and translate each slider 30 and 32.

Figure 6:
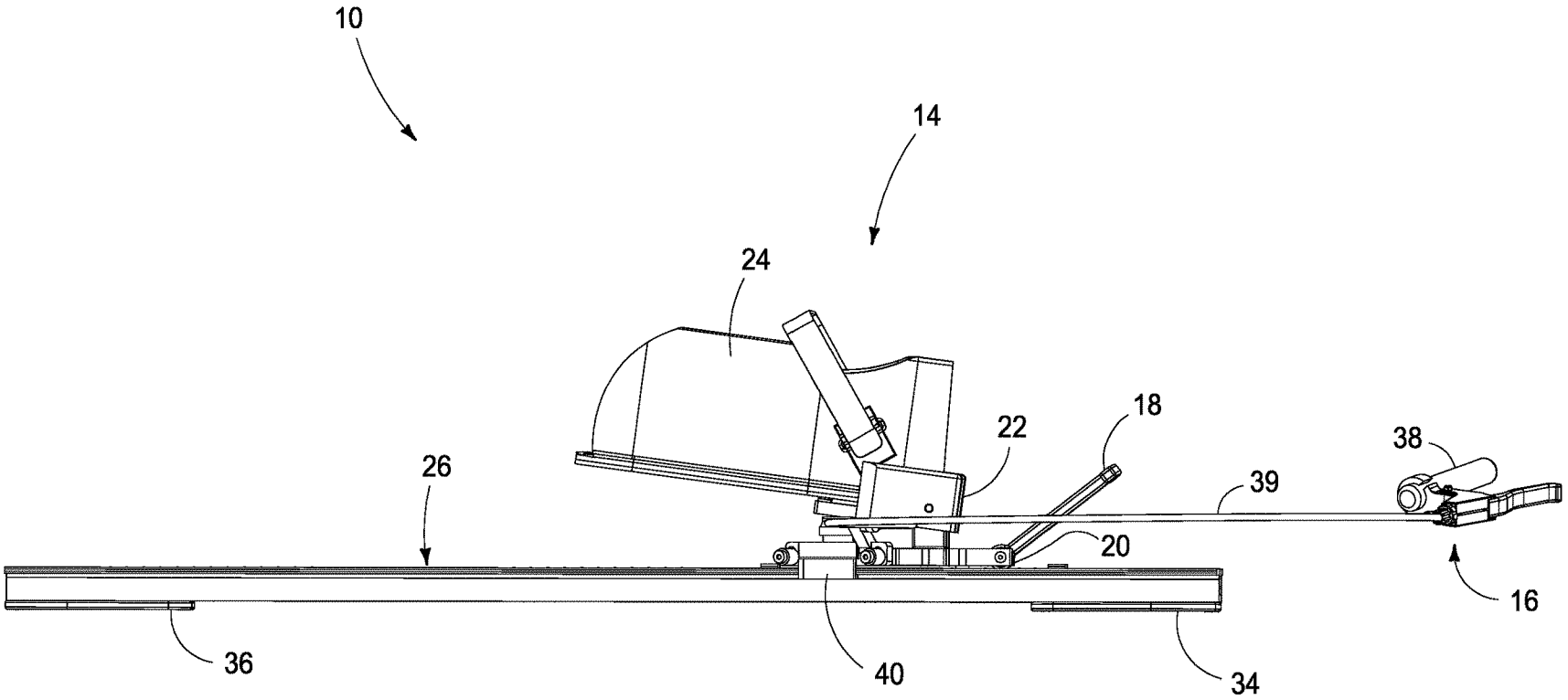
FIG. 6 is a back side view of the articulating knee joint apparatus of FIG. 2.
Figure 7:
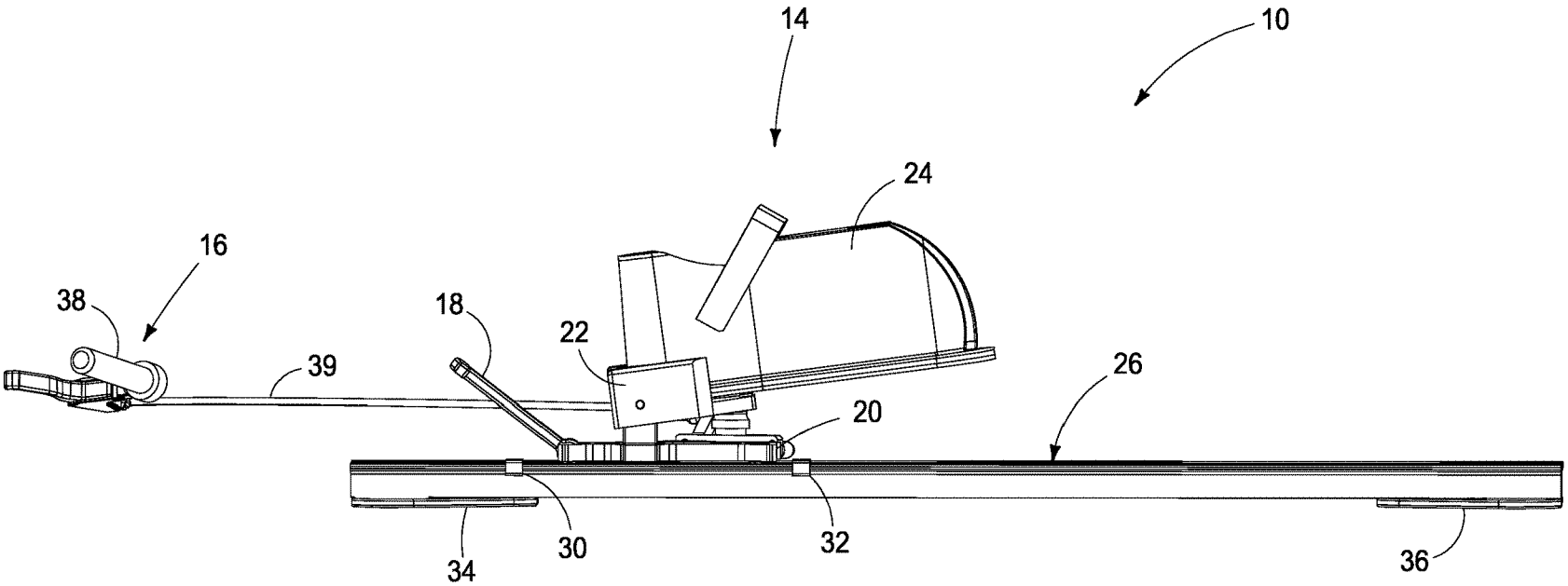
FIG. 7 is a front side view of the articulating knee joint apparatus of FIG. 2.
Figure 11:
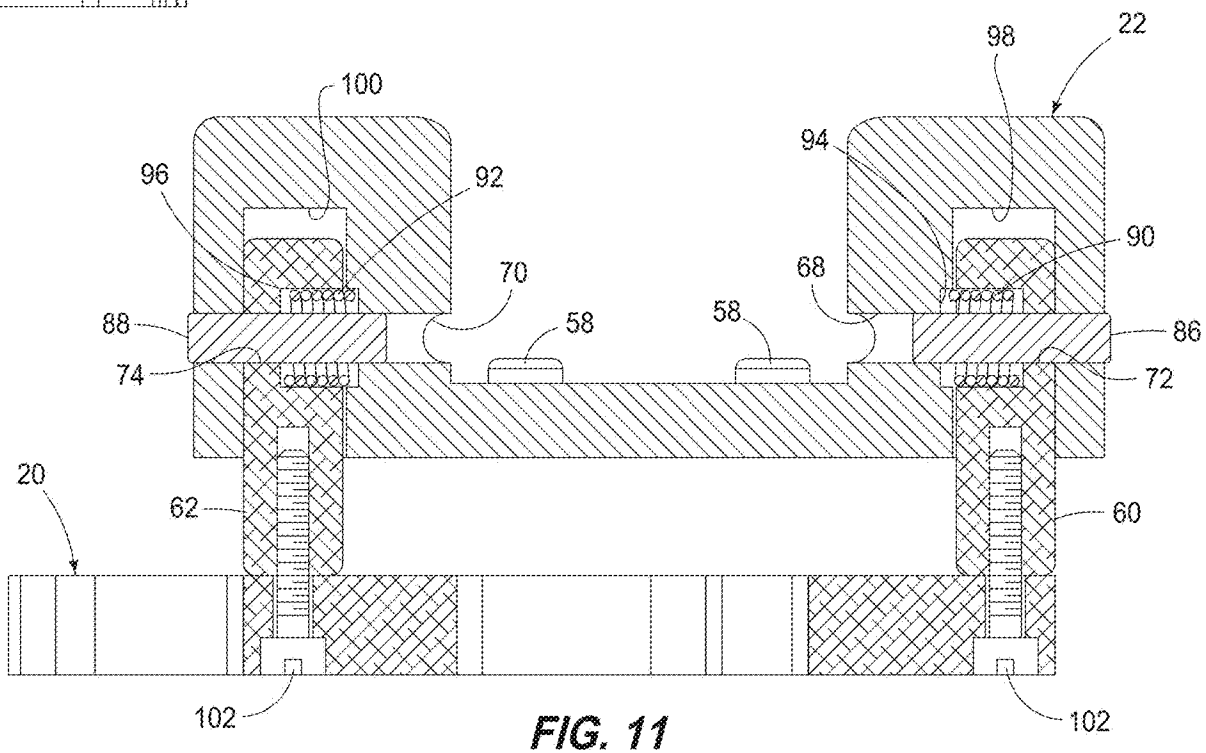
FIG. 11 is a vertical sectional view taken along line 11-11 of FIG. 10.

As shown in FIGS. 1 and 9, an assembly of heel piece 22, boot 24, and foot plate 46 are pivotally mounted to carriage 20. More particularly, heel piece 22 is pivotally affixed onto a pair of upstanding studs, or posts 60 and 62 with a pair of interference fit pins 86 and 88 that are press fit into respective bores 68 and 70 in heel piece 22, as shown in FIGS. 9 and 11. A pair of coil springs 90 and 92 are fit within bores 94 and 96 provided in posts 60 and 62 and extending into a portion of heel piece 22, respectively. According to one construction, each spring 90 and 92 comprises a coil spring available from McMaster-Carr as spring part number 9271K639 left hand wound and 9271K703 right hand wound, respectively. Each spring has a radially outwardly extending leg at each end which is cut to reduce the length. A complementary hole is formed in bores 94 and 96 within heel piece 22 and posts 60 and 62 at each end so that the coil spring is sprung in assembly so as to keep a slight amount of back pressure against a user's foot by raising heel piece 22 (and the boot and user foot). Such construction also serves to keep the boot assembly of foot rest 22, boot 24, and foot plate 46 in an upright position to aid a user when inserting their foot into boot 24. Such pivotally raised position is clearly shown in FIGS. 6 and 7.

Figure 3:
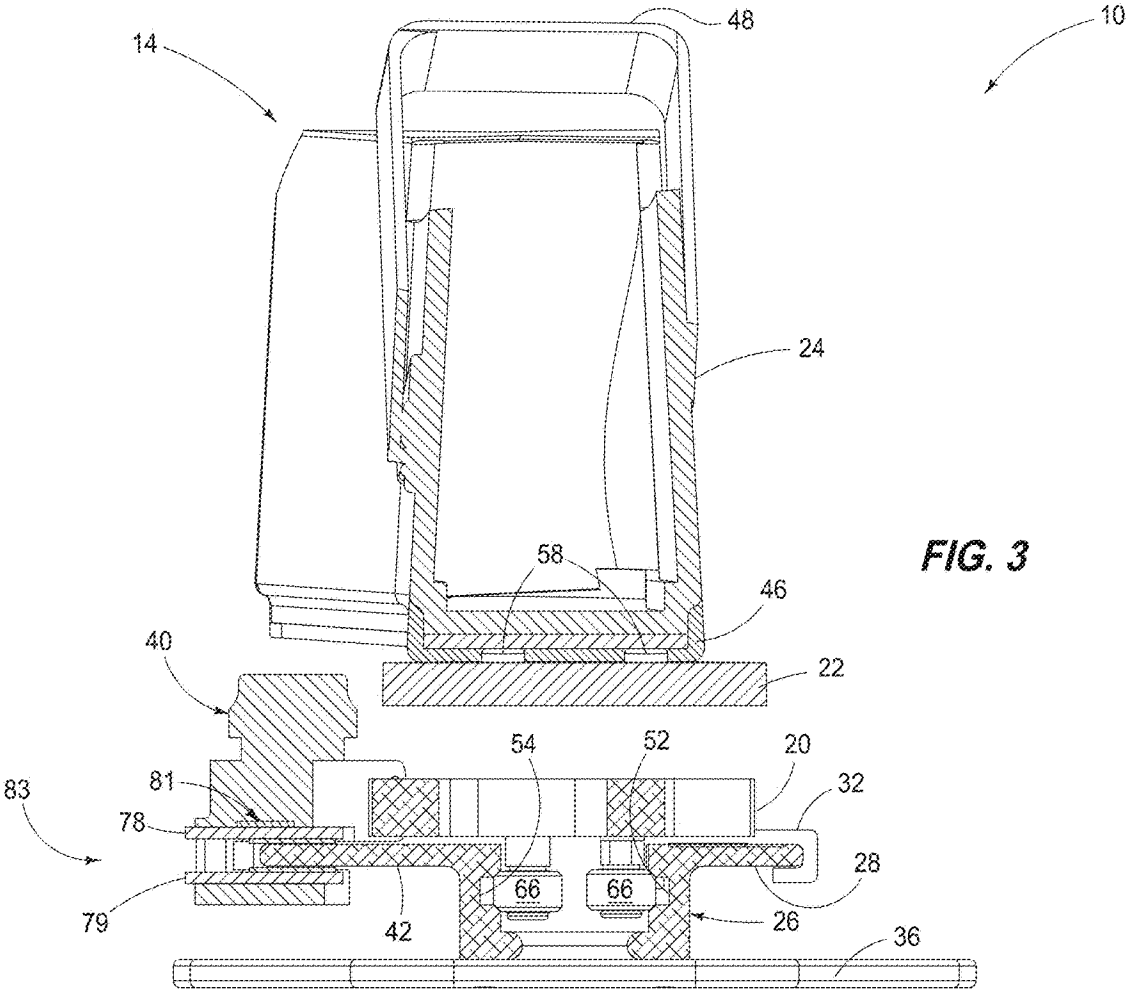
FIG. 3 is a vertical sectional view taken along line 3-3 of FIG. 2 illustrating a friction-reducing bearing surface and brake.

As shown in FIG. 3, caliper brake 40 is mounted to carrier 20 with a pair of threaded fasteners 76 and 77 (see FIG. 9). A pair of opposed caliper brake pads 78 and 79 are urged together to engage opposed surfaces of elongate brake track 42 by pressing the brake handle 38 (see FIG. 1) to secure carrier 20 and slide mount assembly 14 when a user has articulated their leg and knee join to a hyper-extended or a hyper-flexed position along rail member 26. After holding the position for a designated period of time pursuant to a rehabilitation routine or exercise, a user releases pressure on the brake handle to release the carrier 20 from the fixed position along the track 42.

Figure 4:
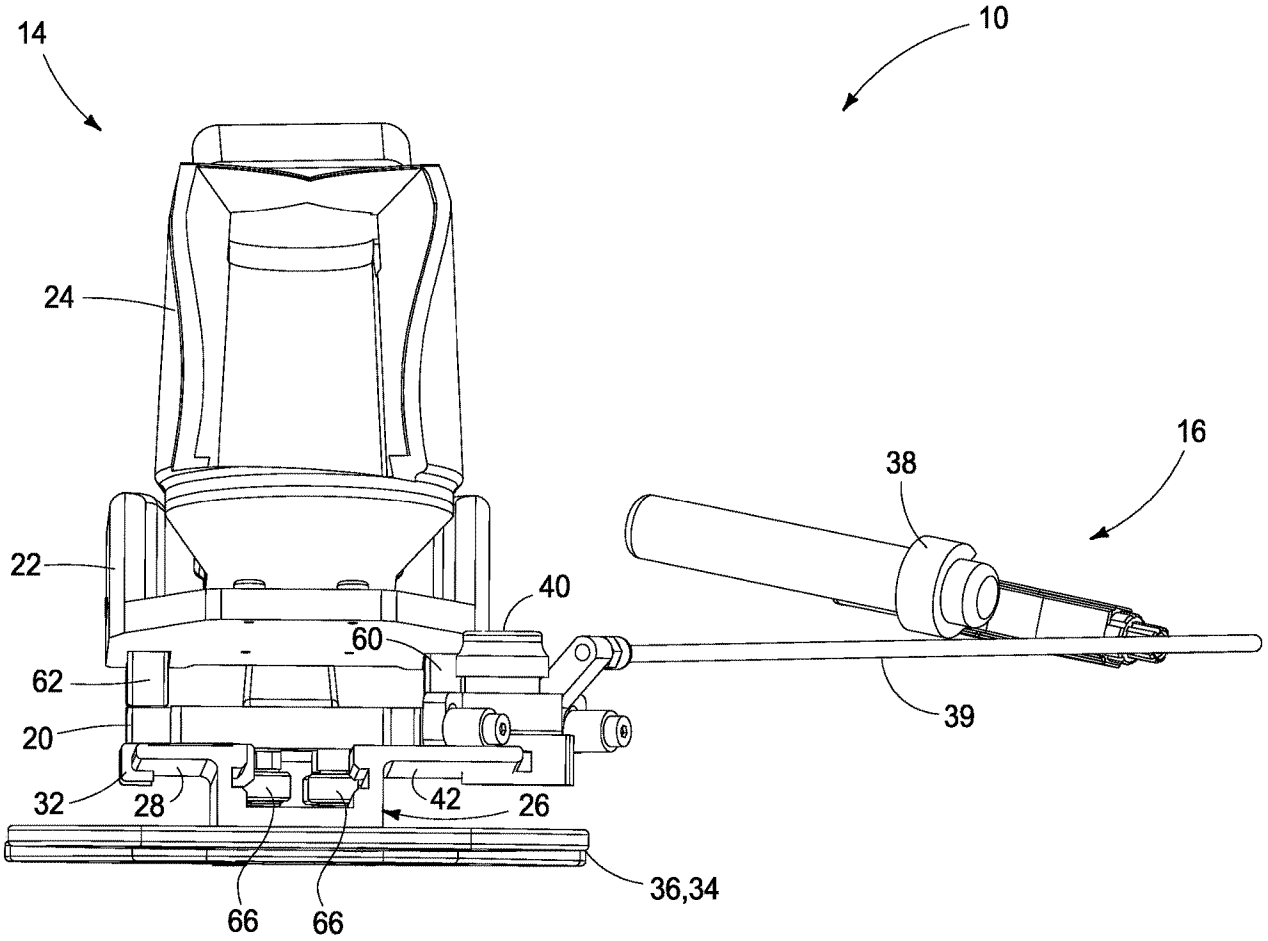
FIG. 4 is a right end view of the articulating knee joint apparatus of FIG. 2.
Figure 5:
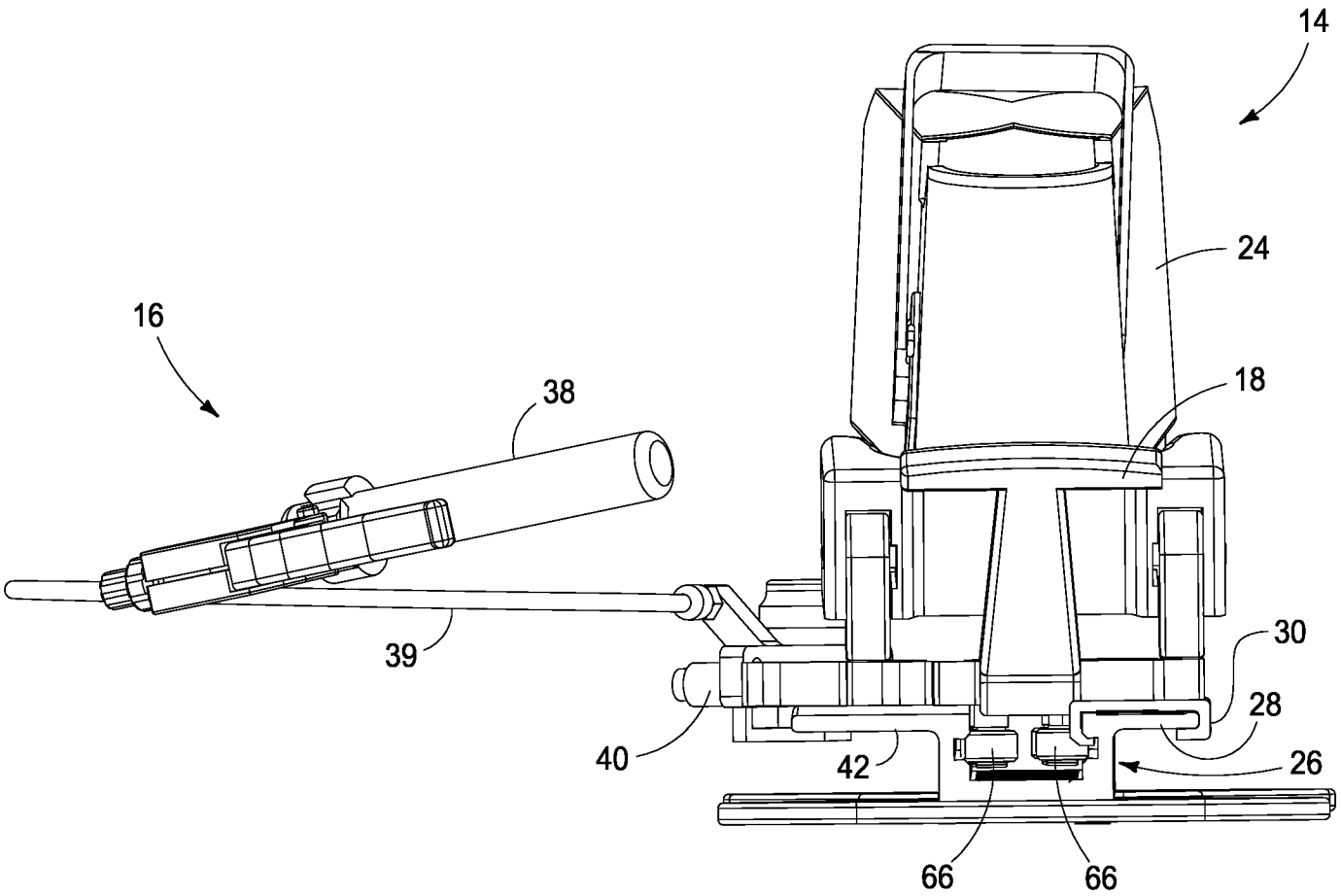
FIG. 5 is a left end view of the articulating knee joint apparatus of FIG. 2.

To enable relatively low friction motion of slide mount assembly 14 along rail member 26 during articulation of a user's knee joint, wheel assemblies 66 travel along longitudinal grooves 52 and 54 within rail member 26, as shown in FIG. 3. Further details of wheel assemblies 66 are shown in FIGS. 4, 5 and 9. According to one construction, wheel assemblies 66 are OpenBuilds wheel kit part #475, available on the Internet at http://openbuildspartstore.com. Such wheel kit includes an OpenBuilds Solid Xtreme V Wheel made from polycarbonate, qty: 2 ball bearings—625 2RS, qty: 2 5 mm precision shims, a lock nut with Nylon insert. A bottom portion of rail member 26 has a plurality of elongate lightening holes, or apertures 50.

As shown in FIGS. 3 and 9, a rectangular array of four threaded standoffs, or bosses 58 are integrally formed in foot plate 46. More particularly, a through-hole centered on each standoff 58 is tapped with a 6-32 thread. The mounting screws (not shown) are four 6-32×½" socket flat head screws that come from the top and pass down thru four drilled and counter sunk holes in the foot plate 46 and thread into standoffs 58 on foot rest, or heel piece 22.

FIGS. 4-7 illustrate the pivotally raised natural orientation of the boot assembly of foot rest 22, boot 24, and foot plate 46 of apparatus 10 resulting from springs 90 and 92 (see FIG. 11). Articulation of a slide mount assembly 14 when a user has engaged a foot within boot 24 and imparts articulation during a rehabilitation exercise will impart a change in pitch angle to such assembly, causing rotation of springs 90 and 92. As slide mount assembly 14 translates between extended and retracted positions along rail member 26 corresponding with extension and flexion, a user holds brake handle 38 on brake system 16 and cable 39 flexes as slide mount assembly 14 reciprocates to-and-fro to accommodate relative motion of brake 40 relative to rail member 26. During motion, sliders 30 and 32 are deposited at maximum positions of translation, enabling a user to record maximal positions of flexion and extension during an exercise regime or rehabilitation exercise. At maximal positions of translation, such an hyperextension or hyperflexion, a user can squeeze brake handle 38 to apply brake 40 and hold such position. Carrier 20 abuts at opposed ends with sliders 30 and 32 and moves sliders to maximal positions along rail member 26.

During reciprocation, wheel assemblies 66 impart reduced-friction between carrier 20 and rail member 26 as shown in FIGS. 4 and 5. Each wheel assembly is affixed to carrier 20 with a 5 mm. bolt and a stand-off. The standoffs for both wheels on one side are straight and the standoffs for the other side are eccentric, enabling adjustment of spacing between the wheel assemblies 66 on left and right sides within rail member 26.

Figure 8:
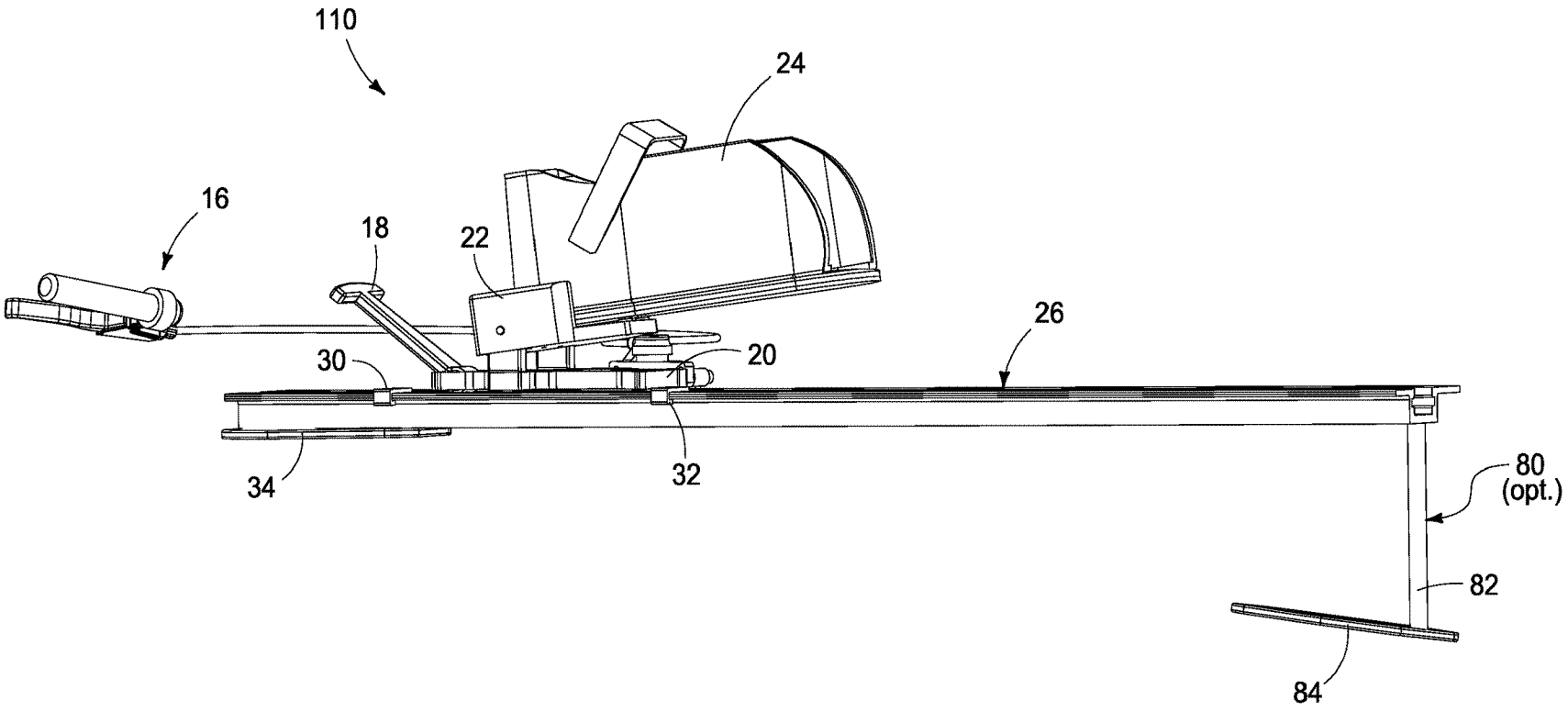
FIG. 8 is a front perspective view of the articulating knee joint apparatus of FIGS. 1-7 having an optional distal end elevation platform.

FIG. 8 illustrates an optional rail lift 80 mounted to a distal end of rail member 26. According to such alternative configuration, base plate 34 is retained at a proximal end of rail member 26. However, base plate 36 is omitted from a distal end of rail member 26 and rail lift 80 is secured with threaded fasteners to rail lift 80 using two of the threaded bores that are otherwise used to mount base plate 36 in the primary configuration. More particularly, rail lift 80 is formed from a central substantially vertical rectangular cross-sectional post 82 that has an enlarged portion at a top end for receiving fasteners that thread into rail member 26. An enlarged base plate 84 is secured to a bottom end of post 80 with another set of threaded fasteners. Rail lift 80 serves to provide rail member 26 is an elevated orientation, pitched relative to a resting position of rail member 26 without use or rail lift 80.

Figure 10:
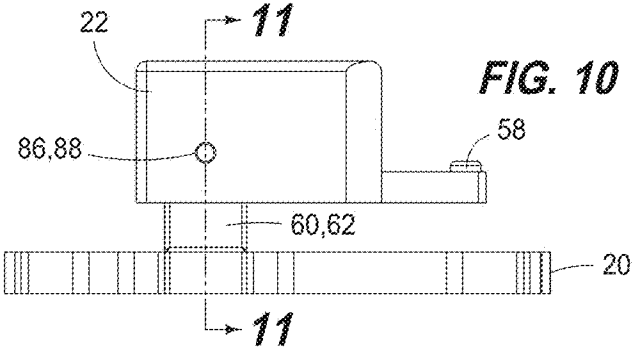
FIG. 10 is a component front view of the foot rest component of the slide mount assembly of FIGS. 1-7 and 9.

FIGS. 10 and 11 illustrate foot rest 22 pivotally affixed atop carriage 20 via solid steel press-fit pins 86 and 88. Pins 86 and 88 extend through bores 72 and 74 to entrap heel piece 22 pivotally atop carriage 20 (see FIG. 9). Foot rest 22 is fixed atop a pair of posts 60 and 62 on carriage 20. Posts 60 and 62 extend within a rectangular cavity 98 and 100, respectively, within foot rest 22. Posts 60 and 62 are secured via threaded fasteners 102 atop carriage 20.

A shown in FIG. 9, apparatus 10 has a linear rail. However, it is understood that an optional elongate rail can be provided with a curved elongate rail having a simple or a compound curved shape. Further optionally, a rail can be provided that is shaped to impart pitch, yaw, and/or roll to a carriage that is traveling along the rail. Further, it is understood that apparatus 10 can be configured to affixed to other body parts in order to articulate and rehabilitate other joints, such as shoulder joints, spinal joints, elbow joints, or any other suitable mammalian joint.

In compliance with the statute, the subject matter disclosed herein has been described in language more or less specific as to structural and methodical features. It is to be understood, however, that the claims are not limited to the specific features shown and described, since the means herein disclosed comprise example embodiments. The claims are thus to be afforded full scope as literally worded, and to be appropriately interpreted in accordance with the doctrine of equivalents.

I claim:

1. An articulating joint exercise apparatus, comprising:

a portable structural frame having an elongate rail with an elongate web member;

a slide having a friction-reducing bearing surface configured for movement along the elongate rail extending between a range corresponding with an extension and a retraction of a user limb and an associated user joint that exceeds an end range of motion for a user under rehabilitation;

a body-engaging mounting fixture affixed for articulation to the slide and configured to attach to the user limb; and a caliper piston brake assembly carried by the slide, configured to engage and disengage with an elongate web member of the elongate rail, and operative to be actuated by the user to affix the slide and the body-engaging mounting fixture at an anatomically limited terminal range for the user with a static stretch of the user joint when the user limb is affixed to the mounting fixture.

2. The articulating joint exercise apparatus of claim 1, further comprising a scale having incremental indicia provided along the elongate rail configured to identify positions of maximum extension and maximum retraction of the slide responsive to the user articulating the user joint while the user limb is affixed to the fixture.

3. The articulating joint exercise apparatus of claim 2, further comprising a position marker slidably carried along the scale by the elongate rail and configured to be moved by the slide and operative to record the maximum extension position of the user joint.

4. The articulating joint exercise apparatus of claim 3, further comprising another position marker slidably carried along the scale by the elongate rail and configured to be moved by the slide and operative to record the maximum retraction position of the user joint.

5. The articulating joint exercise apparatus of claim 1, wherein the elongate rail comprises a linear guide track.

6. The articulating joint exercise apparatus of claim 1, wherein the friction-reducing bearing surface of the slide comprises a rotating bearing surface having a roller bearing raceway.

7. The articulating joint exercise apparatus or claim 1, further comprising a riser support affixed to a distal end of the elongate rail.

8. The articulating joint exercise apparatus of claim 1, wherein the elongate rail is a linear rail.

9. A joint exercise apparatus, comprising:

an elongate rail having an elongate brake track;

a slide having a friction-reducing bearing surface configured for reciprocating movement along the elongate rail corresponding with extension and retraction of a user limb and a user joint;

a body-engaging mounting fixture affixed for articulation to the slide and configured to attach to the user limb; and a guide rail brake carried by the slide having a brake handle assembly disposed remotely from the guide rail brake, the guide rail brake configured to be actuated by a user to affix the slide and the body-engaging mounting fixture at any position along the elongated brake track at one of an anatomically limited terminal range of terminal extension and terminal retraction with a static stretch of the user joint when the user limb is affixed to the mounting fixture.

10. The joint exercise apparatus of claim 9, wherein the guide rail brake comprises a disk brake having a caliper, a piston and a pair of opposed brake pads.

11. The joint exerciser apparatus of claim 9, wherein the elongated rail is a linear rail providing a linear travel path for the slide.

12. The joint exercise apparatus of claim 9, wherein a cross-sectional configuration of the elongate rail and the slide are non-circular, complementary, and configured to restrain rotation of the slide relative to the elongated rail in a direction perpendicular to a travel direction.

13. The joint exercise apparatus of claim 9, wherein the elongate rail has a body of generally rectangular cross-sectional configuration with a bottom wall, a pair of spaced-apart and generally parallel side walls extending generally perpendicular to the bottom wall, and a top wall.

14. The joint exercise apparatus of claim 9, wherein the slide comprises a slide bearing including a ball bearing raceway configured for sliding engagement along the elongate rail, and further comprising a scale extending along the elongate rail and a position marking arranged to mark a maximal position of the slide along the elongate rail corresponding with one of the terminal flexion and the terminal extension.

15. A patient exercise apparatus, comprising:

an elongate rail having a body of generally rectangular cross-sectional configuration with a bottom wall, a pair of spaced-apart and parallel side walls extending generally perpendicular to the bottom wall, and a top wall and a laterally extending web flange extending outwardly of one of the pair of parallel side walls configured to provide a braking surface;

a slide having a friction-reducing bearing surface configured for reciprocating movement along the elongate rail corresponding with extension and retraction of a user limb and the user joint;

a body-engaging mounting fixture affixed for articulation to the slide and configured to attach to the user limb; and a brake carried by the slide and configured to be actuated by a user along the brake surface to affix the slide and the body-engaging mounting fixture at one of an anatomically limited terminal range of terminal extension and terminal retraction with a static stretch of the user joint when the limb of the user joint is affixed to the mounting fixture.

16. The patient exercise apparatus of claim 15, wherein the elongate rail is a linear rail.

17. A method of performing a rehabilitation exercise on a user joint, comprising:

providing a frame having an elongate rail with laterally extending web flange providing a brake track with a braking surface, a slide having a friction-reducing bearing surface configured for reciprocating movement along the elongate rail, a body-engaging mounting fixture affixed pivotally to the slide, and a rail brake configured to engage and disengage with the brake track;

affixing a user limb associated with the user joint to the body-engaging mounting fixture;

moving the slide along the elongate rail by articulating the user limb and the user joint to a position that exceeds an end range for a user under rehabilitation corresponding with one of terminal extension and terminal flexion beyond an anatomically limited terminal range comprising a static stretch position; and affixing the slide at the position by engaging the rail brake to hold the user limb and the user joint in the static stretch position.

18. The method of performing a rehabilitation exercise on the user joint of claim 17, wherein moving the slide comprises articulating the user limb and the user joint to a position corresponding with the terminal extension and affixing the slide, the user limb and the user joint in the position corresponding with the terminal extension by affixing the slide along the elongate rail with the rail brake.

19. The method of performing a rehabilitation exercise on the user joint of claim 17, wherein moving the slide comprises articulating the user limb and the user joint to a position corresponding with terminal flexion and affixing the slide, the user limb and the user joint in the position of corresponding with the terminal flexion by affixing the slide along the elongate rail with the rail brake.

20. The method of performing a rehabilitation exercise on the user joint of claim 17, further comprising recording a maximal position of translation of the slide relative to the elongate rail corresponding with one of the terminal flexion and the terminal extension.

* * * * *